US005666596A

United States Patent [19]

Yoo

[11] Patent Number: 5,666,596

[45] Date of Patent: Sep. 9, 1997

[54] PROCESS CARTRIDGE OF AN IMAGE FORMING DEVICE

[75] Inventor: Yong-Baek Yoo, Suwon, Rep. of Korea

[73] Assignee: SamSung Electronics Co., Ltd., Suwon, Rep. of Korea

[21] Appl. No.: 694,389

[22] Filed: Sep. 16, 1996

[30] Foreign Application Priority Data

Sep. 19, 1995 [KR] Rep. of Korea ..... 30757/1995

[51] Int. Cl.[6] ..... G03G 15/00

[52] U.S. Cl. ..... 399/111; 399/159; 399/176; 399/318

[58] Field of Search ..... 399/111, 167, 399/159, 174, 176, 313, 318

[56] References Cited

U.S. PATENT DOCUMENTS 5,008,706 4/1991 Ohmori et al. ..... 399/174
5,083,144 1/1992 Altmann ..... 399/159
5,293,199 3/1994 Saito et al. ..... 399/279 X
5,321,469 6/1994 Ahn ..... 399/279 X
5,321,473 6/1994 Azami ..... 399/279 X
5,515,154 5/1996 Hasegawa et al. ..... 399/167 X

*Primary Examiner*—S. Lee
*Attorney, Agent, or Firm*—Robert E. Bushnell, Esq.

[57] ABSTRACT

A process cartridge of an image forming device in which a driving gear for driving a charging roller and a transfer roller is not utilized. The process cartridge of an image forming device, comprising: a developing unit having a photosensitive drum and a charging roller for charging the photosensitive drum; a driving gear to which driving force is delivered, the driving gear providing a driving force for rotating the photosensitive drum; and friction portions for driving the charging roller and transfer roller, the friction portions being provided on opposite sides of an outer circumferential surface of the photosensitive drum, wherein the charging roller and the photosensitive drum are provided to be in contact with each other and the transfer roller and the photosensitive drum are provided to be in contact with each other, so that the charging roller and transfer roller are driven by a friction force caused by rotation of the photosensitive drum.

20 Claims, 3 Drawing Sheets

PROCESS CARTRIDGE OF AN IMAGE FORMING DEVICE

CLAIM OF PRIORITY

This application makes reference to, incorporates the same herein, and claims all benefits accruing under 35 U.S.C §119 from an application entitled A Processor Cartridge Of An Image Forming Device earlier filed in the Korean Industrial Property Office on 19 Sep. 1995, and there duly assigned Ser. No. 30757/1995 by that Office.

BACKGROUND OF THE INVENTION

1. Field of the Invention

The present invention relates to an electrophotography processor of a laser beam printer, a copying machine, and a facsimile system for a general sheet of paper, and more particularly to a process cartridge of an image forming device for driving a charging roller and a transfer roller by utilizing a friction portion provided on outer circumferential surfaces (periphery) of both end portions of a photosensitive drum utilizing a frictional force between the drum and rollers.

2. Description of the Related Art

FIG. 1 is a view illustrating a general construction of a prior electrophotography processor, and a printing process of the electrophotography processor will be described with reference to FIG. 1. A surface of a photosensitive drum 80 is electrically and regularly charged by a corona discharge of an electrical charger 72. The surface of photosensitive drum 80, which is electrically charged by rotating the photosensitive drum 80 with respect to electrical charger 72, receives an electric signal for forming an image through a latent image forming device 73 to thereby expose the surface of photosensitive drum 80 to a light. Thus an electrostatic latent image is formed on that potion of photosensitive drum 80 exposed to the light in an initially charging state. When the photosensitive drum portion on which the electrostatic latent image is formed passes a developing unit 74 adjacent to the surface of the photosensitive drum 80 the electrostatic latent image is developed by a toner so that the electrostatic latent image is changed into a visible image. Then, a recording sheet of paper 76 in feed cassette 77 is fed by a feeding roller 75, so that the toner image of the surface of photosensitive drum 80 is transcribed to paper 76 by a high pressure action of the transcriber 78. A separator 79 separates paper 76 from the surface of photosensitive drum 80 by an electrostatic force. Paper 76 is then transferred and passed between a pressing roller 82 and a heating roller 81 of a fixing unit, and an image is fixed on paper 76 by heat and pressure, and the resulting printed sheet of paper is transferred to a stacker 83 thus accomplishing a desiring printing operation. Afterwards, the latent toner which remains on the surface of photosensitive drum 80 after passing transcriber 78 is eliminated by a cleaner 70, and the remaining charge is eliminated by a latent image eliminating lamp 71. A problem exists however because of the use of a corona by electrical charger 72 since it requires a high voltage and generates ozone in large quantity.

Where the device of FIG. 1 utilizes a rotating photosensitive drum 80, a stationary charger 72 and a stationary transcriber 78, the device of FIG. 2 utilizes a process cartridge having rotating photosensitive drum 40, a rotating charging roller 44 and a rotating transfer roller 42 engaged to one another. In FIG. 2, photosensitive drum 40 is rotated at a certain speed, and one side of the photosensitive drum 40 is provided with a first driving gear 46 being rotated by the driving force of a main motor (not shown), and the other side of the photosensitive drum 40 is provided with a second driving gear 48 for driving a charging roller gear 50 and a transfer roller gear 52. Since second driving gear 48 is engaged with the charging roller gear 50 for rotating the charging roller 42, charging roller 42 electrically and regularly charges the surface of photosensitive drum 40 by a contact charging method thus overcoming the problem of corona discharge described above with respect to FIG. 1. Additionally, since second driving gear 48 is also engaged with transfer roller gear 52, transfer roller 44 transfers a toner image on the surface of photosensitive drum 40 to a sheet of paper.

Referring to FIG. 3, first driving gear 46 is engaged with a developing roller gear 60 for rotating a developing roller 56 for developing the toner to the electrostatic latent image formed on the surface of photosensitive drum 40. Developing roller gear 60 is further engaged with a feeding roller gear 62 for rotating a feeding roller 58 for transferring toner from a hopper (not shown) to developing roller 56.

A problem exists with respect to the device of FIG. 2, however, because second driving gear 48, charging roller gear 50 and transfer roller gear 52 are provided to drive the charging roller 42 and the transfer roller 44 thus increasing manufacturing cost, and jitter is generated during driving of the gears, and in which second driving gear 48, transfer roller gear 52 and charging roller gear 50 are provided to each roller thus increasing the number of steps needed in an assembling process thereby reducing productivity Also, there have been problems in which first driving gear 46 and second driving gear 48 tend to deteriorate a transferring regularity and a charging regularity and to deteriorate a regularity of a nip by a difference of a pressure delivered to both sides of photosensitive drum 40. Also, there has been problem in which a size of a product is large to thereby deteriorate a fine view of the product.

As an alternative to utilizing the gearing engagements described above with respect to FIGS. 2 and 3 for rotating charging roller and transfer roller, U.S. Pat. No. 5,140,371 to Yuji Ishihara et al, and entitled *Contact Charging Member, Contact Charging Method Making Use Of It, And Apparatus Making Use Of It*, contemplates passively rotating a charging roller and a transfer roller by keeping the charging roller and transfer roller in contact with a rotating photosensitive drum at a given pressure. Ishihara et al. proposes a contact pressure between the charging roller and the photosensitive drum be at a linear pressure of from 10 to 100 g/cm.

U.S. Pat. No. 5,235,386 to Hideyuki Yano, et al. entitled *Charging Device Having Charging Member, Process Cartridge And Image Forming Apparatus*, discusses problems that can occur in the above mentioned contact charging method and apparatus. Yano et al. suggests that these problems can be caused caused by toner, external additives, dust, etc., being unevenly attached to the charging roller thus causing improper charging, or charging failure, and toner fusion. Yano et al. suggests that a coefficient of friction between the photosensitive drum and the contact roller be not less than 0.4 and further suggest a pressure of 400 g between the photosensitive drum and the contact roller.

Due to a desire to increase the rotation speed of the photosensitive drum, I have found that a problem with respect to the above mentioned patents exists in that the increased rotation speed may cause a slippage between the photosensitive drum and the contact roller as well as between the photosensitive drum and the transfer roller, causing uneven charging and transfer of an image.

SUMMARY OF THE INVENTION

Accordingly, an object of the present invention is to provide a process cartridge of an image forming device in which driving gears for driving a charging roller and a transfer roller are not utilized.

Another object of the present invention is to provide a process cartridge of an image forming device for preventing jitter from being generated and preventing a nip regularity, a charging regularity and a transferring regularity from being deteriorated.

Yet another object of the present invention is to provide a process cartridge of an image forming device for improving a productivity by reducing the number of assembly components and reducing the number of steps of an assembling process.

Yet still another object is to provide a process cartridge of an image forming device for increasing the friction and pressure between the photosensitive drum and the contact roller and between the photosensitive drum and the transfer roller.

A further object is to increase the friction and pressure between the photosensitive drum and the contact roller and between the photosensitive drum and the transfer roller by forming a friction portion on opposite end portions of the outer circumferential surface of a photosensitive drum for driving the charging roller and transfer roller.

To achieve these objects and other objects, there is provided a process cartridge of an image forming device, comprising: a developing unit having a photosensitive drum and a charging roller for charging the photosensitive drum; a driving gear to which driving force is delivered, the driving gear providing a driving force for rotating the photosensitive drum; and friction portions for driving the charging roller and transfer roller, the friction portions being provided on opposite sides of an outer circumferential surface of the photosensitive drum, wherein the charging roller and the photosensitive drum are provided to be in contact with each other and the transfer roller and the photosensitive drum are provided to be in contact with each other, so that the charging roller and transfer roller are driven by a friction force caused by rotation of the photosensitive drum.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
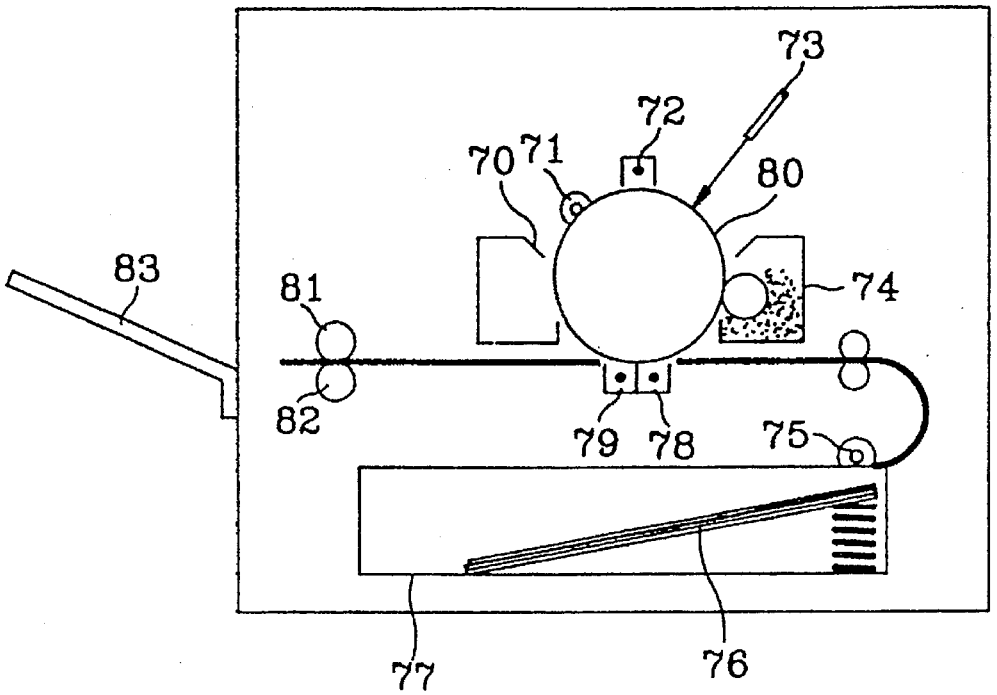
(PRIOR ART) Fig. 1
FIG. 1 is a view illustrating a schematic construction of a prior image forming device of an electrophotography processor.
Figure 2:
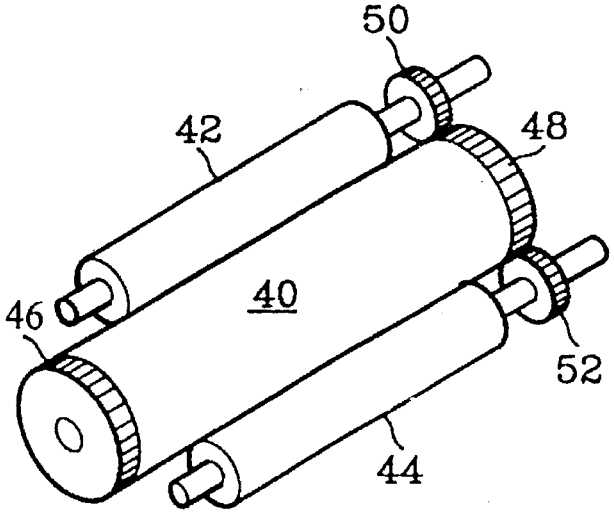
(PRIOR ART) Fig. 2
FIG. 2 is a perspective view illustrating an operation state of a photosensitive drum, a charging roller and a transfer roller which are gearingly engaged to one another in yet another prior image forming device.
Figure 3:
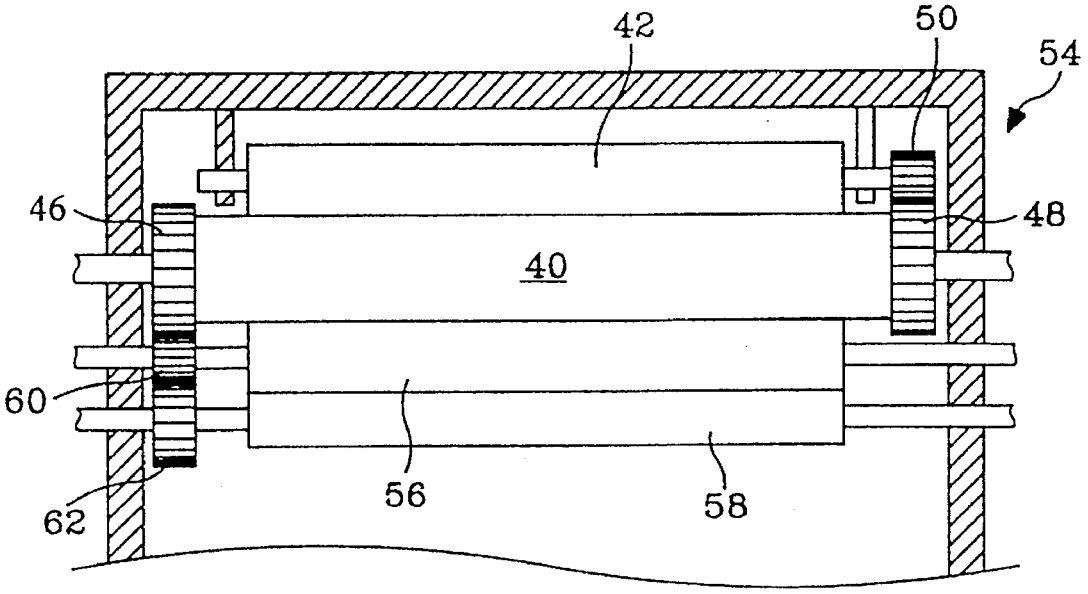
(PRIOR ART) Fig. 3
FIG. 3 is a top view illustrating the internal construction of the process cartridge and developing unit of the prior image forming device of FIG. 2.
Figure 4:
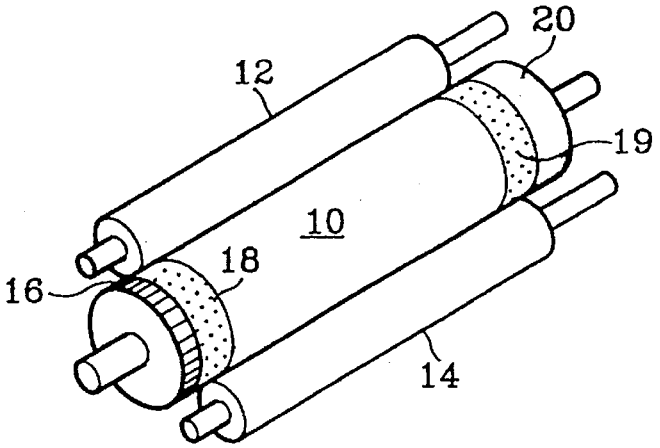
FIG. 4 is a perspective view illustrating an operation state of a photosensitive drum, a charging roller and a transfer roller which are frictionally engaged to one another according to the principles of the present invention.
Figure 5:
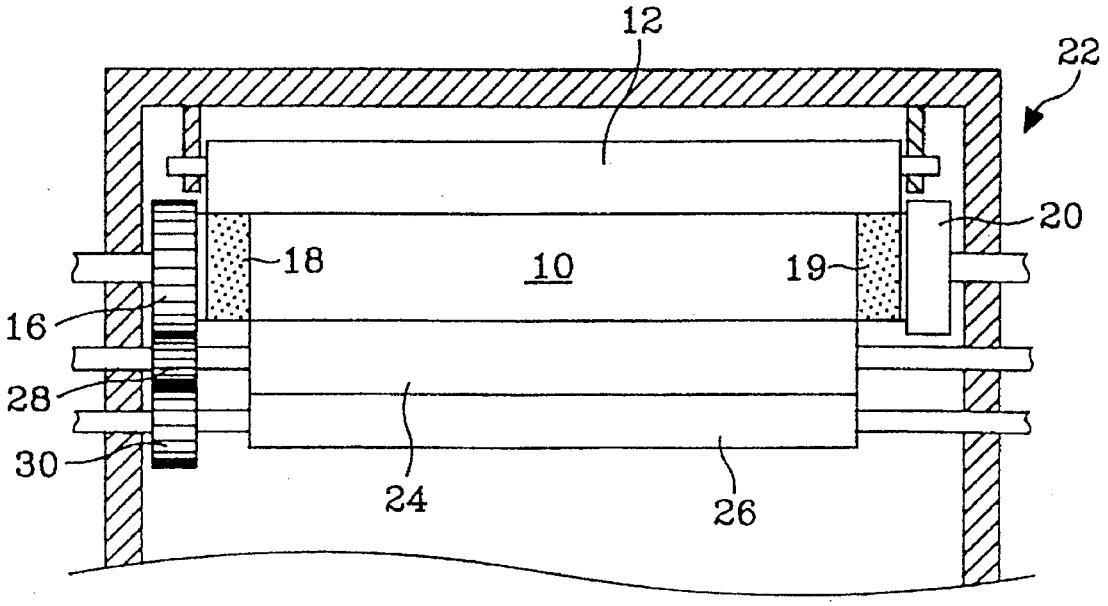
FIG. 5 is a top view illustrating an internal construction of a process cartridge and developing unit according to the principles of the present invention.
Figure 6:
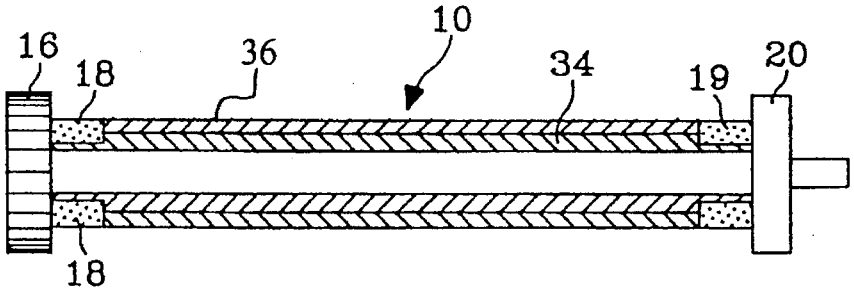
FIG. 6 is a sectional view illustrating a construction of a photosensitive drum of FIG. 5 according to the principles of the present invention.

In the following, a process cartridge of an image forming device according to the present invention will be described with reference to FIGS. 4, 5, and 6.

A photosensitive drum 10 is rotated at a certain speed adjacent to a developing unit 22. One end of photosensitive drum 10 is provided with a driving gear 16 which is rotated by driving force of a main motor (not shown), and the opposite end of photosensitive drum 10 is provided with a flange 20 in engagement with a frame of the developing unit 22. Opposite end portions of photosensitive drum 10 are comprised of friction portions 18 and 19 forming outer circumferential surfaces of the end portions of photosensitive drum 10. As photosensitive drum 10 rotates, friction portions 18 and 19 drive charging roller 12 and transfer roller 14.

Photosensitive drum 10 is manufactured using an aluminum material 34, friction portions 18 and 19, and coating part, i.e., surface, 36 having an electrical property. Friction portions 18 and 19 may be formed by any one of roughly processing the outer circumferential surfaces of the end portions of photosensitive drum 10, forming a plurality of small projections on the outer circumferential surfaces of the end portions of photosensitive drum 10, and attaching a rubber pad to the outer circumferential surfaces of the end portions of photosensitive drum 10. Coating part 36 having the electrical property is formed between the friction portions 18 and 19, and the height of the coating part 36 is at the same height of the friction portions 18 and 19. In other words, the periphery, or cylindrical form, of photosensitive drum 10 has a constant circumference. As shown in FIG. 6, both end portions of aluminum material 34 of photosensitive drum 10 are stepped to accommodate friction portions 18 and 19.

The periphery of photosensitive drum 10 contacts charging roller 12, manufactured using a rubber material, under a constant pressure. The pressure between charging roller 12 and photosensitive drum 10 is preferably 3 $kg/cm^2$. The length of the contact surface of charging roller 12 and the length of the contact surface of photosensitive drum 10 are the same.

The periphery of photosensitive drum 10 contacts transfer roller 14, manufactured using a sponge material for transferring the toner image from surface 36 of photosensitive drum 10 onto a sheet of paper under a constant pressure. The pressure between transfer roller 14 and photosensitive drum 10 is preferably 8 $kg/cm^2$. The length of the contact surface of transfer roller 14 and the length of the contact surface of photosensitive drum 10 are the same.

Driving gear 16 of photosensitive drum 10 is engaged with a developing roller gear 28 for rotating a developing roller 24 for developing the toner to a electrostatic latent image formed on surface 36 of photosensitive drum 10. Developing roller gear 28 is further engaged with a feeding roller gear 30 for rotating a feeding roller 26 which transfers the constantly charged toner to developing roller 24. Also, the length of surface 36 between friction portions 18 and 19 is wider than the length of the rubber layer of developing roller 24 and the length of the sponge layer of feeding roller 26.

An operation and an effect of the process cartridge of the image forming device according to the present invention constructed as described above will be described in the following.

Driving gear 16 of the photosensitive drum 10 is rotated counter clockwise by the driving force of the main motor (not shown), thus rotating photosensitive drum 10 counter clockwise. Accordingly, since charging roller 12 and transfer roller 14 are in contact with friction portions 18 and 19, charging roller 12 is rotated clockwise by the friction force of friction portions 18 and 19 to thereby electrically and regularly charge surface 36 of photosensitive drum 10. Also, transfer roller 14 is rotated clockwise by the friction force of friction portions 18 and 19, thereby to transcribe the toner image on surface 36 of photosensitive drum 10 to a sheet of paper.

As discussed above, the process cartridge of the image forming device according to the present invention the use of friction portions 18 and 19 instead of second driving gear 48, charging roller gear 50 and transfer roller gear 52 to drive charging roller 12 and transfer roller 14 advantageously reduces manufacturing cost, prevents jitter from being generated, assures the nip regularity, the charge regularity and the transferring regularity, reduces the number of steps required during the process cartridge assembling process to improve productivity, and reduces the size of the process cartridge since gears 48, 50 and 52 are not necessary.

While there have been illustrated and described what are considered to be preferred embodiments of the present invention, it will be understood by those skilled in the art that various changes and modifications may be made, and equivalents may be substituted for elements thereof without departing from the true scope of the present invention.

What is claimed is:

1. A process cartridge of an image forming device, comprising:

a photosensitive drum having a central latent image forming portion and two friction end portions; and a charging roller which is in contact with said photosensitive drum so as to be rotated by said two friction end portions of said photosensitive drum when said photosensitive drum is rotated during an image forming operation.

2. The process cartridge as set forth in claim 1, further comprising a contact pressure of 3 kg/cm$^2$ between said charging roller and said photosensitive drum.

3. The process cartridge as set forth in claim 1, further comprising: a transfer roller which is in contact with said photosensitive drum so as to be rotated by said two friction end portions of said photosensitive drum when said photosensitive drum is rotated during said image forming operation.

4. The process cartridge as set forth in claim 3, further comprising a contact pressure of 8 kg/cm$^2$ between said transfer roller and said photosensitive drum.

5. The process cartridge as set forth in claim 1, further comprising said two friction end portions being formed by rubber pads.

6. The process cartridge as set forth in claim 1, further comprising said two friction end portions being formed by roughly processing predetermined surface areas of said photosensitive drum.

7. The process cartridge as set forth in claim 1, further comprised of said two friction end portions being formed by a plurality of small protrusions.

8. The process cartridge as set forth in claim 1, further comprised of said photosensitive drum having an inner aluminum portion, said inner aluminum portion having two stepped areas, said two friction end portions each being formed by a rubber layer disposed over respective ones of said stepped areas and a coating layer having an electrical property forming said central latent image forming portion between said two friction end portions.

9. A process cartridge of an image forming device, said process cartridge having a developing roller and a feeding roller, said process cartridge comprising:

a photosensitive drum having circumferential surface comprised of a central latent image forming surface portion and two friction end surface portions; and a charging roller for contact charging said central latent image forming surface portion of said circumferential surface of said photosensitive drum, said charging roller being rotated by said two friction end surface portions of said photosensitive drum when said photosensitive drum is rotated during an image forming operation.

10. The process cartridge as set forth in claim 9, further comprising a contact pressure of 3 kg/cm$^2$ between said charging roller and said photosensitive drum.

11. The process cartridge as set forth in claim 9, further comprising:

a transfer roller for transferring a toner image from said central latent image forming surface portion of said circumferential surface of said photosensitive drum to a sheet of paper, said transfer roller being rotated by said two friction end surface portions of said photosensitive drum when said photosensitive drum is rotated during said image forming operation.

12. The process cartridge as set forth in claim 11, further comprising a contact pressure of 8 kg/cm$^2$ between said transfer roller and said photosensitive drum.

13. The process cartridge as set forth in claim 9, further comprising:

said central latent image forming surface portion of said circumferential surface of said photosensitive drum having a length equal to a length of said developing roller.

14. The process cartridge as set forth in claim 9, further comprising:

said central latent image forming surface portion of said circumferential surface of said photosensitive drum having a length equal to a length of said feeding roller.

15. A process cartridge of an image forming device, said process cartridge having a developing roller and a feeding roller, said process cartridge comprising:

a photosensitive drum having circumferential surface comprised of a central latent image forming portion and two friction end portions;

a charging roller for contact charging said central latent image forming portion of said circumferential surface of said photosensitive drum, said charging roller being rotated by said two friction end portions of said photosensitive drum when said photosensitive drum is rotated during an image forming operation; and a transfer roller for transferring a toner image from said central latent image forming portion of said circumferential surface of said photosensitive drum to a print medium, said transfer roller being rotated by said two friction end portions of said photosensitive drum when said photosensitive drum is rotated during said image forming operation.

16. The process cartridge as set forth in claim 15, further comprising a contact pressure of 3 kg/cm$^2$ between said charging roller and said photosensitive drum.

17. The process cartridge as set forth in claim 15 further comprising a contact pressure of 8 kg/cm$^2$ between said transfer roller and said photosensitive drum.

18. The process cartridge as set forth in claim 15, further comprised of said photosensitive drum having an inner aluminum portion, said inner aluminum portion having two stepped areas, said two friction end portions each being formed by a rubber layer disposed over respective ones of said stepped areas, and a coating layer having an electrical property forming said central latent image forming portion between said two friction end portions.

19. The process cartridge as set forth in claim 15, further comprising:

a length of said circumferential surface of said photosensitive drum being equal to a length of a contact surface area of said charging roller; and a length a contact surface area of said transfer roller being equal to said length of said contact surface area of said charging roller.

20. The process cartridge as set forth in claim 19, further comprising:

said central latent image forming portion of said circumferential surface of said photosensitive drum having a length equal to a length of said developing roller, the length of said developing roller being equal to a length of said feeding roller.

* * * * *